US010946504B1

(12) United States Patent
Pedicini et al.

(10) Patent No.: US 10,946,504 B1
(45) Date of Patent: Mar. 16, 2021

(54) FASTENER DRIVING APPARATUS

(71) Applicant: TRICORD SOLUTIONS, INC., Franklin, TN (US)

(72) Inventors: Christopher Pedicini, Franklin, TN (US); John Witzigreuter, Canton, GA (US)

(73) Assignee: TRICORD SOLUTIONS, INC., Franklin, TN (US)

( * ) Notice: Subject to any disclaimer, the term of this patent is extended or adjusted under 35 U.S.C. 154(b) by 0 days.

(21) Appl. No.: 16/897,304

(22) Filed: Jun. 10, 2020

Related U.S. Application Data

(60) Provisional application No. 63/020,299, filed on May 5, 2020, provisional application No. 62/900,751, filed on Sep. 16, 2019.

(51) Int. Cl.
*B25C 1/04* (2006.01)
*B25C 1/06* (2006.01)

(52) U.S. Cl.
CPC ..... *B25C 1/041* (2013.01); *B25C 1/047* (2013.01); *B25C 1/06* (2013.01)

(58) Field of Classification Search
CPC .. B25C 1/06; B25C 1/047; B25C 1/04; B25C 1/041; B25C 5/13
See application file for complete search history.

(56) References Cited

U.S. PATENT DOCUMENTS

| | | | | |
|---|---|---|---|---|
| 5,503,319 | A * | 4/1996 | Lai | B25C 5/15 173/203 |
| 5,720,423 | A * | 2/1998 | Kondo | B25C 1/04 227/130 |
| 8,011,441 | B2 * | 9/2011 | Leimbach | B25C 1/047 173/1 |
| 8,011,547 | B2 * | 9/2011 | Leimbach | B25C 1/06 227/8 |
| 8,602,282 | B2 * | 12/2013 | Leimbach | B25C 1/041 227/8 |
| 8,763,874 | B2 * | 7/2014 | McCardle | B25C 1/06 227/8 |
| 9,539,714 | B1 * | 1/2017 | Pedicini | B25C 1/04 |
| 9,962,821 | B2 * | 5/2018 | Pedicini | B25C 1/06 |
| 10,065,300 | B2 * | 9/2018 | Pedicini | B25C 1/06 |
| 10,525,575 | B2 * | 1/2020 | Tanji | B25F 5/006 |
| 10,569,403 | B2 * | 2/2020 | Namouz | B25C 1/047 |

(Continued)

*Primary Examiner* — Andrew M Tecco
(74) *Attorney, Agent, or Firm* — Xsensus LLP

(57) ABSTRACT

A fastener driving device includes a fastener and at least one gas spring. Additionally, the fastener driving device includes a drive mechanism, the drive mechanism being capable of selectively engaging and disengaging the at least one gas spring, the at least one gas spring capable of moving to an energized position upon being engaged by the drive mechanism. Additionally, the device includes an anvil, wherein the drive mechanism includes a first lifting mechanism and a second lifting mechanism, wherein the first lifting mechanism actuates the at least one gas spring for a portion of an operation cycle, and the second lifting mechanism thereafter actuates the at least one gas spring for a subsequent portion of the operation cycle before the drive mechanism ceases applying a force on the at least one gas spring and the at least one gas spring releases a portion of its potential energy and accelerates the anvil to drive a fastener.

18 Claims, 9 Drawing Sheets

(56) References Cited

U.S. PATENT DOCUMENTS

| | | | | |
|---|---|---|---|---|
| 10,695,899 | B2 * | 6/2020 | Scott | B25C 1/041 |
| 2007/0102471 | A1 * | 5/2007 | Gross | B25C 1/06<br>227/131 |
| 2009/0090759 | A1 * | 4/2009 | Leimbach | B25C 1/047<br>227/10 |
| 2012/0286014 | A1 * | 11/2012 | Pedicini | B25C 1/04<br>227/4 |
| 2016/0096259 | A1 * | 4/2016 | Pedicini | B25C 1/047<br>227/146 |
| 2016/0214248 | A1 * | 7/2016 | Pedicini | B25C 1/047 |
| 2017/0100829 | A1 * | 4/2017 | Pedicini | B25C 1/047 |
| 2018/0133763 | A1 * | 5/2018 | Kehoe | B05B 1/005 |

* cited by examiner

FASTENER DRIVING APPARATUS

CROSS-REFERENCE TO RELATED APPLICATIONS

This application claims the benefit of U.S. Provisional Application No. 63/020,299, filed May 5, 2020, and U.S. Provisional Application No. 62/900,751, filed Sep. 16, 2019, each of which are incorporated herein by reference in their entirety.

BACKGROUND

Electromechanical fastener driving apparatuses (also referred to herein as a "driver," "gun" or "device") known in the art often weigh generally less than 15 pounds and may be configured for an entirely portable operation. Contractors and homeowners commonly use power-assisted devices for driving fasteners into wood. These power-assisted devices for driving fasteners can be in the form of finishing fastener systems used in baseboards or crown molding in house and household projects, or in the form of common fastener systems that are used to make walls or hang sheathing onto same, for example. These systems can be portable (i.e., not connected or tethered to an air compressor or wall outlet) or non-portable.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

According to aspects of the disclosed subject matter, a fastener driving device includes a fastener and at least one gas spring. Additionally, the fastener driving device includes a drive mechanism, the drive mechanism being capable of selectively engaging and disengaging the at least one gas spring, the at least one gas spring capable of moving to an energized position upon being engaged by the drive mechanism. Additionally, the device includes an anvil, wherein the drive mechanism includes a first lifting mechanism and a second lifting mechanism, wherein the first lifting mechanism actuates the at least one gas spring for a portion of an operation cycle, and the second lifting mechanism thereafter actuates the at least one gas spring for a subsequent portion of the operation cycle before the drive mechanism ceases applying a force on the at least one gas spring and the at least one gas spring releases a portion of its potential energy and accelerates the anvil to drive a fastener.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
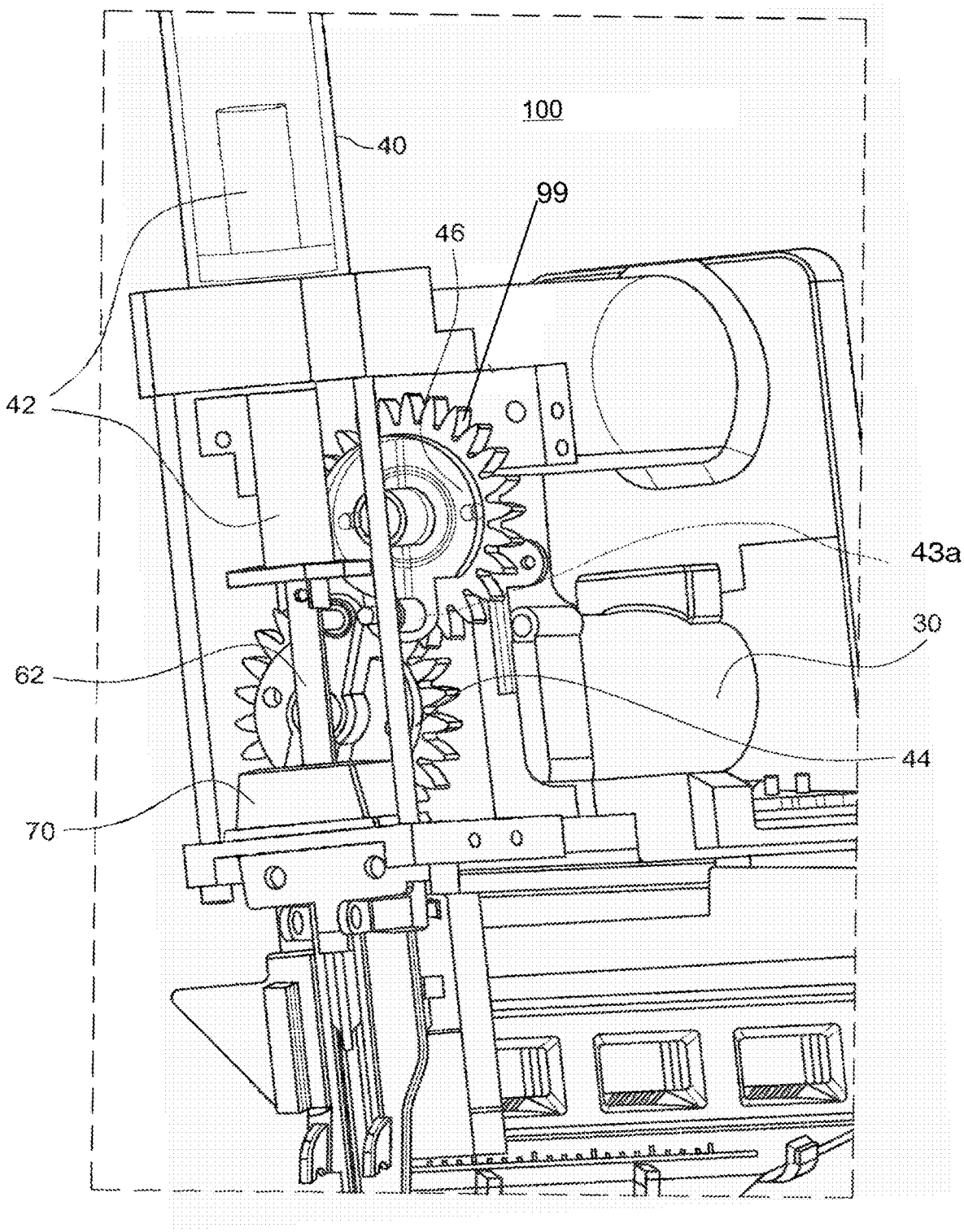
FIG. 1 illustrates a perspective view of a fastener driving apparatus according to one or more exemplary aspects of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the"

include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Currently available electromechanical fastener driving devices suffer from various disadvantages. For example, currently available devices can have complex, expensive and unreliable designs. Fuel powered mechanisms such as Paslode™ achieve portability but require consumable fuels and are expensive. Rotating flywheel designs such as Dewalt™ have complicated coupling or clutching mechanisms based on frictional means. This adds to their expense.

Another disadvantage of currently available electromechanical faster driving devices includes poor ergonomics. For example, the fuel powered mechanisms have loud combustion reports and combustion fumes. The multiple impact devices are fatiguing and are noisy. Additionally, non-portability can be an issue. For example, traditional fastener guns are tethered to a fixed compressor and thus must maintain a separate supply line.

Other disadvantages of currently available electromechanical faster driving devices include high reaction force and short life, safety issues, and return mechanisms. Regarding the high reaction force and short life, mechanical spring driven mechanisms have high tool reaction forces because of their long fastener drive times. Additionally, the springs are not rated for these types of duty cycles leading to premature failure. Furthermore, consumers are unhappy with their inability to seat longer fasteners or work with denser wood species. Regarding safety issues, "air spring" and heavy spring driven designs suffer from safety issues, particularly for longer fasteners, since the predisposition of the anvil is towards the substrate. During jam clearing, this can cause the anvil to strike the operators hand.

Regarding the return mechanisms in currently available electromechanical faster driving devices, the return mechanisms in most of these devices involve taking some of the drive energy. For example, either there is a bungee or spring return of the driving anvil assembly or there is a vacuum or air pressure spring formed during the movement of the anvil. All of these mechanisms take energy away from the drive stroke and decrease efficiency.

In light of these various disadvantages, there exists the need for a fastener driving device that overcomes these various disadvantages by improving efficiency and safety, for example, as further described herein.

Referring now to the drawings, wherein like reference numerals designate identical or corresponding parts throughout the several views:

FIG. 1 illustrates a perspective view of a fastener driving apparatus 100 (also referred to herein as the apparatus 100) according to one or more exemplary aspects of the disclosed subject matter. Generally, the apparatus 100 derives its power from an electrical source, preferably rechargeable batteries, and uses a motor to actuate a gas spring. In one aspect, a first (e.g., lower) lifter and a second (e.g., upper) lifter actuate an anvil or anvil assembly which is part of or operatively coupled to the gas spring. The actuation of the anvil or anvil assembly upon the gas spring increases the potential energy in the gas spring. After a sufficient increase in such potential energy, the anvil or anvil assembly may be released by or disconnected from the lifter or lifters and the rod of the gas spring may commence movement to cause the anvil or anvil assembly anvil to move. For example, the movement is toward and into contact with a fastener such that the anvil drives the fastener. After such movement of the anvil or anvil assembly, the lifter or lifters may re-engage the anvil or anvil assembly to return the anvil or anvil assembly to a position where it may act or acts on the gas spring to increase the potential energy contained in the gas spring.

By using a multi-stage lifting configuration that is in contact with an anvil or anvil assembly during a substantial portion of the operational cycle, the apparatus 100 allows for more precise control of the operational cycle and an improved safety profile. For example, the lower lifter can raise the anvil or anvil assembly from a starting point that is most distal from the gas spring to a half-way stability point, at which time the motor may stop so that the lower lifter is no longer exerting a force on the anvil/anvil assembly, and the upper lifter may continue to pull the anvil/anvil assembly further upward to energize the gas spring. Thereafter, the upper lifter may disconnect from the anvil/anvil assembly to allow the gas spring to act on and move the anvil/anvil assembly to drive a fastener. In an embodiment, the one or more lifters compress the gas spring to at least 80% of its full stroke prior to stopping the operational cycle. As a result, when the cycle restarts (e.g., a user pulls the trigger of the fastener driving apparatus 100) the gas spring compresses an additional 20% at most before the gas spring is released from the one or more lifters and drives the fastener. This is advantageous because the latency (defined as the time between the user pulling the trigger and a fastener being driven into a substrate) is very short.

The apparatus 100 can also include at least one sensor (e.g., sensor 80) or other means of detecting a stall and/or a jam in the operation of the apparatus 100. For example, the sensor 80 can be a hall switch, mechanical switch, optical switch, and the like. For example, there may be an event that the drive of a fastener is not complete (e.g., if the anvil/anvil assembly jams in a downward/driving direction). The sensor or sensors could allow the motor to operate to take the drive force off the anvil and/or anvil assembly before signaling it to stop. Additionally, if it is detected that the current drawn by the motor of the apparatus exceeds the nominal current (e.g., a predetermined multiple of the nominal current) that would be required to compress the gas spring, a jam would be indicated and the control circuit can cut, or reduce, power to the motor and, optionally, lock the lifter or lifters and/or anvil/anvil assembly in place to allow clearing of the jam, for example. For example, in response to the motor current exceeding 150% (e.g., a predetermined multiple of the nominal current) of an average current drawn while the potential energy of the gas spring is increasing, the control circuit can reduce power to the motor. Alternatively, or additionally, the control circuit can lock the lifter or lifters, or otherwise allow other mechanical elements to lock the lifter or lifters, as a one-way clutch, for example. The advantages of this aspect include the ability for the mechanism to self-clear a light jam and protecting the apparatus from damage in the case of a very heavy jam. Furthermore, it protects the user by relieving the downward pressure on the anvil in the event the user has to clear a jam.

The apparatus 100 can also include a one-way bearing that prevents the anvil/anvil assembly from being driven backwards in connection with its driving of a fastener or a nail. The apparatus may also comprise a bumper that may receive at least a portion of the force of impact of the anvil/anvil assembly during the operational cycle.

Figure 2:
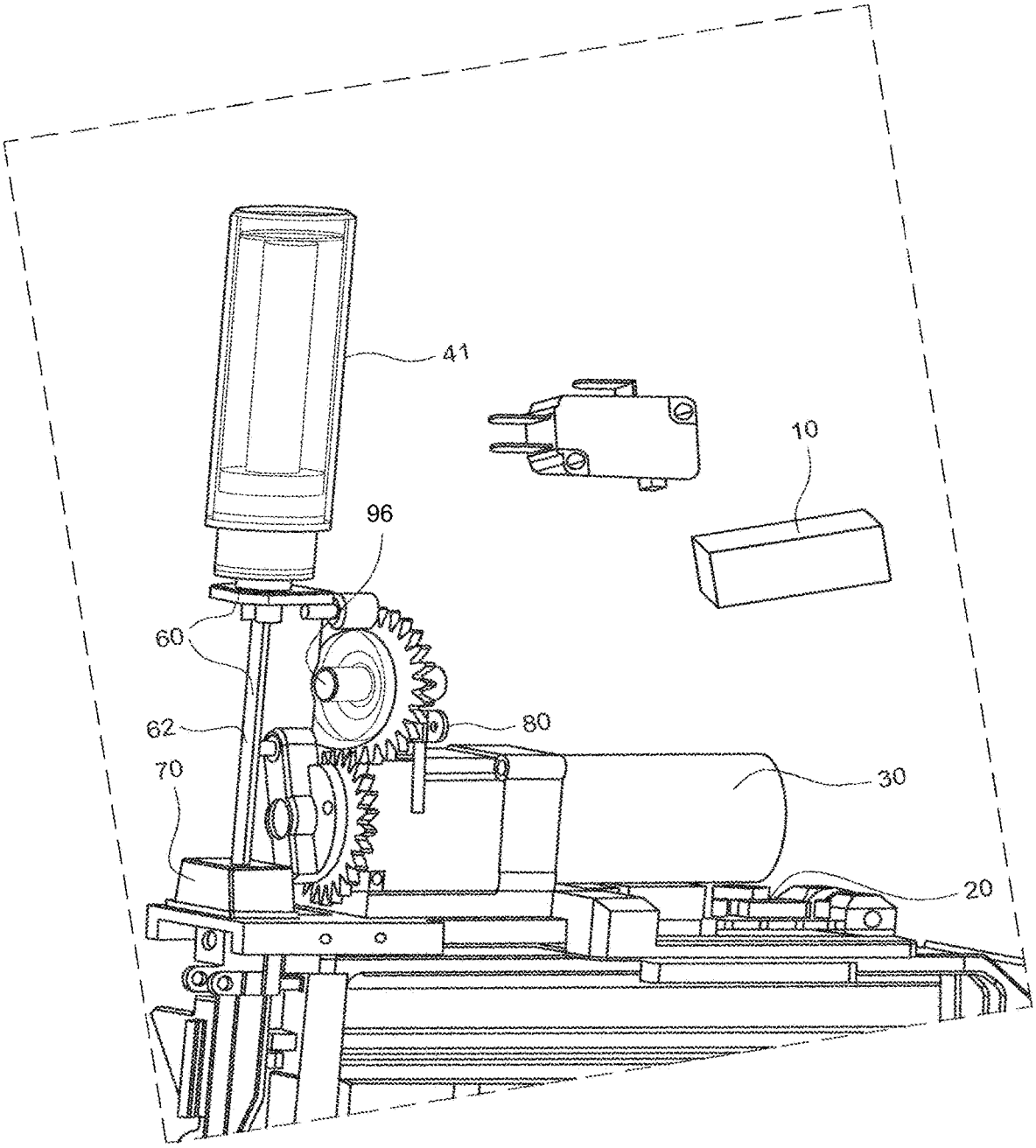
FIG. 2 illustrates a perspective view of a fastener driving apparatus in which the anvil drive assembly is near the point of maximum potential energy in the gas spring according to one or more exemplary aspects of the disclosed subject matter.
Figure 3:
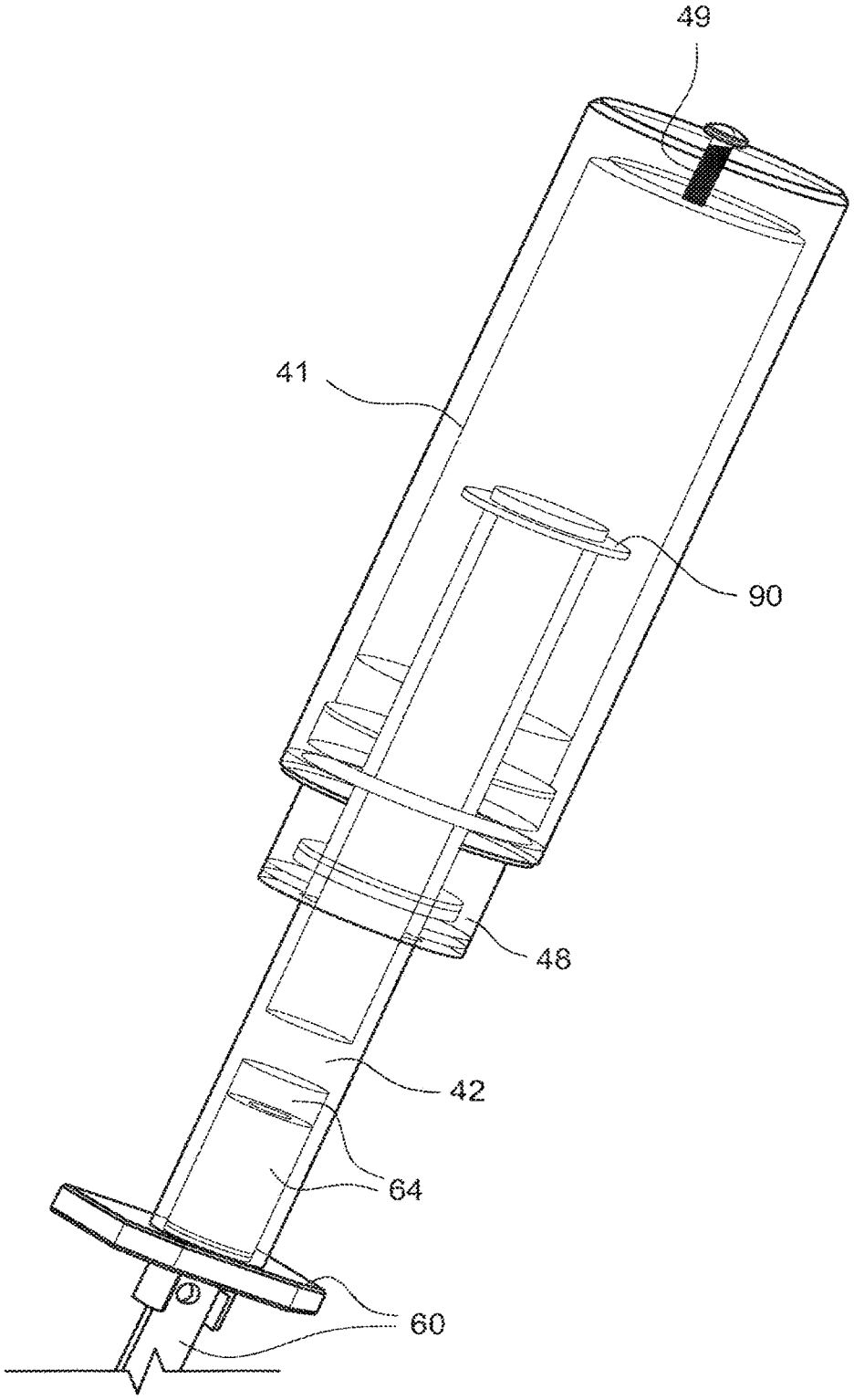
FIG. 3 illustrates a perspective view of a gas spring for a fastener driving apparatus according to one or more exemplary aspects of the disclosed subject matter.

FIG. 2 illustrates a perspective view of a fastener driving apparatus in which the anvil drive assembly is near the point of maximum potential energy in the gas spring according to one or more exemplary aspects of the disclosed subject matter, and FIG. 3 illustrates a perspective view of a gas spring for a fastener driving apparatus according to one or more exemplary aspects of the disclosed subject matter.

Referring to FIGS. 1-3, the apparatus 100 can include a power source 10, a control circuit 20, a motor 30, a gas spring 40, at least a first lifter 44 and a second lifter 46, an anvil 62 (which may be part of an anvil assembly 60) and at least one bumper 70. The gas spring includes a gas spring rod 42 that is at least partially disposed within a sealed chamber (also referred to herein as a gas spring cylinder) 41 as shown in FIG. 3, and which rod 42 is operatively coupled to the anvil 62/anvil assembly 60. A bumper 70 is preferably disposed as part of the apparatus to absorb a portion of the force of impact of the anvil 62/anvil assembly 60.

Figure 5:
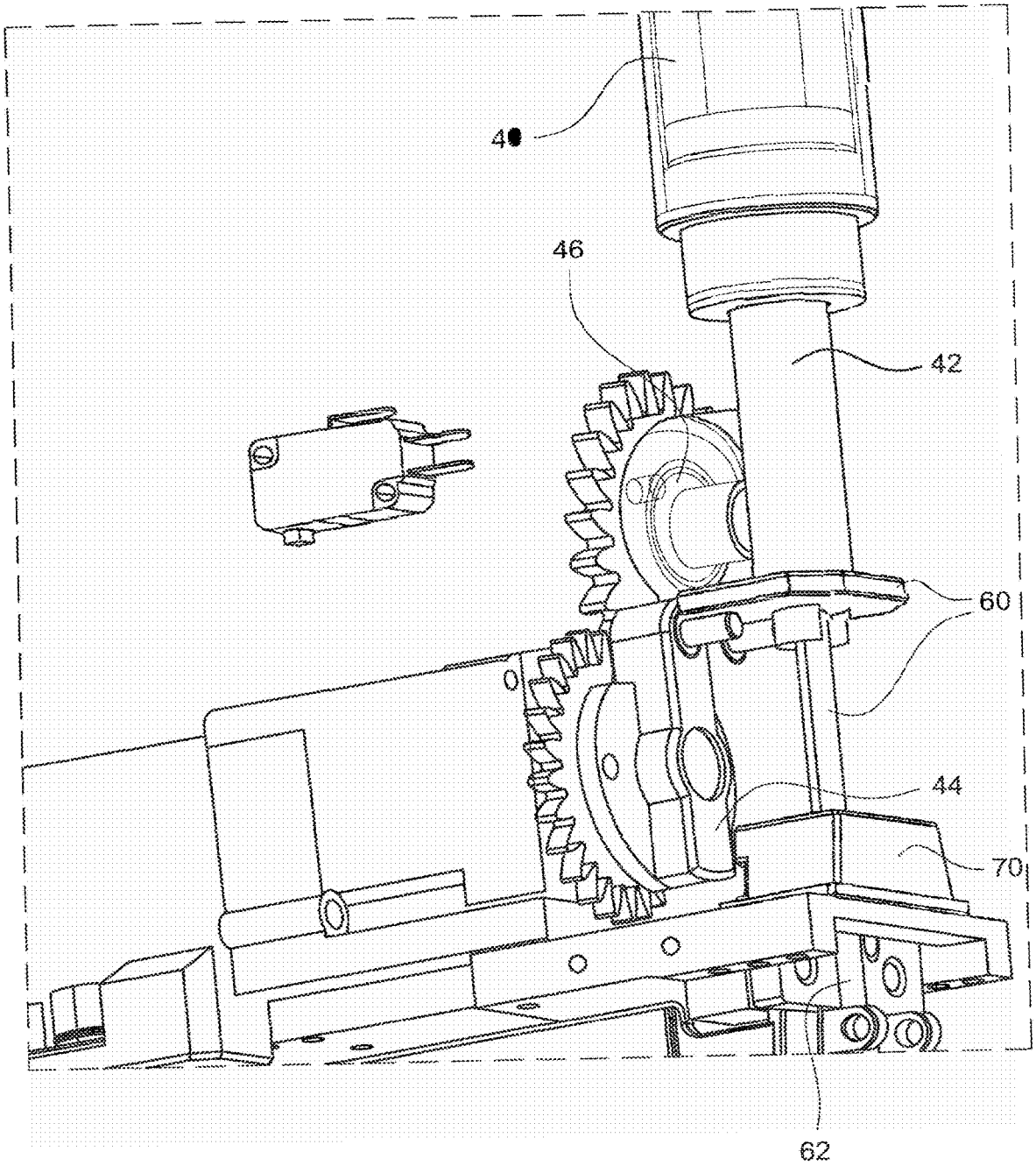
FIG. 5 illustrates a perspective view of a fastener driving apparatus in which the apparatus stops in in an intermediate position according to one or more exemplary aspects of the disclosed subject matter.

The first and second lifting mechanisms 44 and 46 (each also referred to as a "lifter" herein) may comprise at least one toothed gear 99 that is capable of engaging the anvil 62/anvil assembly 60 to selectively move the anvil 62/anvil assembly 60 during the operational cycle of the apparatus 100. The first lifter 44 may move the anvil 62/anvil assembly 60 from a first position or a position that is distal to the gas spring 40 toward the gas spring 40 by rotating itself, the gear teeth of the lifter, or other engagement region of the lifter (such as a roller 43*a*), to engage the anvil 62/anvil assembly 60. In an embodiment, the first lifter 44 moves the anvil 62/anvil assembly 60 a portion of the distance toward the gas spring 40, and as the anvil 62/anvil assembly 60 reaches a stable midpoint (an example of which midpoint is shown in FIG. 5), the motor 30 can stop or remain running. The motor 30 can then restart if it stopped and the second lifter 46 thereafter continues to lift the anvil 62/anvil assembly 60 toward and upon/against the gas spring 40, thus causing the rod 42 of the gas spring to move to increase the potential energy within the gas spring. The second lifter 46 includes a region that does not engage the anvil 62/anvil assembly 60, and when that region is reached, the gas spring may then act on the anvil 62/anvil assembly 60 to actuate the anvil 62/anvil assembly 60 away from the gas spring to drive a fastener (e.g., through the potential energy that had accumulated in the gas spring). The motor can continue to operate and engage the at least one gas spring to relieve at least 80% of the gas spring force on the anvil after the anvil has been released from the lifter and moved towards the fastener.

The apparatus 100 may also include a sensor 80 (e.g., shown in FIG. 2). The sensor 80 can be configured to detect if the anvil assembly had completed a fastener drive and/or a safe stopping point in the cycle. Additionally, the sensor 80 can be configured to detect if an abnormal event, such as a fastener jam in the apparatus 100 that requires removal of a fastener, has occurred, for example. The detection can also occur by reading the current drawn by the motor 30, for example. If the current drawn is determined to be in excess of the nominal current for compressing the gas spring rod 42, the sensor 80 can then signal the control circuit 20 to cut power to the motor 30, thus preventing damage to the apparatus 100. Additionally, the control circuit can allow the lifter to engage and reduce the load on the anvil 62 or anvil assembly 60 from the gas spring. This improves the safety profile by allowing the jam to be cleared safely because, as a result of the lifter, the jam can be cleared when it is not under load. In one aspect, the sensor can be configured to detect a movement of the anvil or anvil assembly (such as a movement away from the drive of the fastener), and the at least one lifter may remain powered until the sensor detects such movement of the anvil 62 or anvil assembly 60.

The gas spring 40 may further comprise at least one of a seal 48 and a fill valve 49 as shown in FIG. 3. The seal and/or fill valve may preferably comprise a single element such as a lip or cup seal. In an embodiment, the seal is a rod seal that is disposed on the rod of the gas spring. For example, the gas spring can include a chamber and a rod disposed within the chamber, and a seal (e.g., a rod seal) can act against the rod (e.g., the rod can move linearly within the chamber and with respect to the rod seal). The stroke of the rod is preferably at least 80% of the stroke length of the anvil 62/anvil assembly 60. These features resulted in numerous unexpected operational and geometry improvements. Piston seals are used by Senco™ and others and can result in various limitations. In one aspect, by using the rod seal, the pressure in the gas spring can be maintained at least 200 psi for the entire operational cycle of the of the apparatus 100. It was unexpectedly discovered that by employing a rod seal along with high gas pressure (e.g., in excess of 200 psi) that the volume of the gas spring cylinder could be significantly reduced as compared to other electromechanical fastener driving devices. For example, using a rod seal with a ¾" diameter rod inside a gas spring of 1.25" diameter with a gas pressure of 400 psia, such configuration was able to accomplish the equivalent energy delivery of a 1.5" diameter gas spring piston with a gas pressure of 100 psia and cylinder diameter of 3.0". In a preferred embodiment, the operating pressure of the apparatus is between 300 psia and 500 psia. It was a further unexpected discovery that the increased pressure allows the present device to function more uniformly with respect to ambient pressure. For example, in a city at elevation such as Albuquerque, N. Mex., the nominal atmospheric pressure causes a reduction of energy of about 3% in the prior art but less than 1% in case of the present apparatus. A further unexpected advantage of the rod seal was that the pressure increase inside the gas spring was far less than as seen in fastener drivers that comprise a piston seal instead of a rod seal. That is, an advantage is that the rod seal permits an apparatus of a more compact size as the rod seal does not require as much gas chamber volume for the same stroke in order to achieve the constant force. The loss of energy in a gas spring stroke is related to the amount of "air volume displaced" during the movement of the gas spring from an energized to a de-energized position. The air volume displaced in the case of a rod seal is the area of the rod times the stroke. In the case of a piston seal, it is the area of the piston times the stroke, which is a larger area due to the fact that the piston is necessarily larger than the rod. This resulted in an unexpected increase in the conversion of gas spring energy to fastener drive energy in that there was less loss with the rod seal than would be seen in a piston seal. In summary, using a rod seal for the gas spring in a gas spring driven fastener driving device (e.g., apparatus 100) improves efficiency, reduces size and reduces internal cylinder pressure changed caused by the increase in potential energy during gas spring activation. This further increases efficiency because a decrease in the compression ratio yields less energy loss due to heat of compression.

In an embodiment, the apparatus 100 does not have a fill valve. During activation, the gas spring fill valve can leak due to the impacting nature of a fastener driving device. Accordingly, by not requiring a fill valve, the potential for leaks that would have existed due to the fill valve can be reduced.

Figure 8:
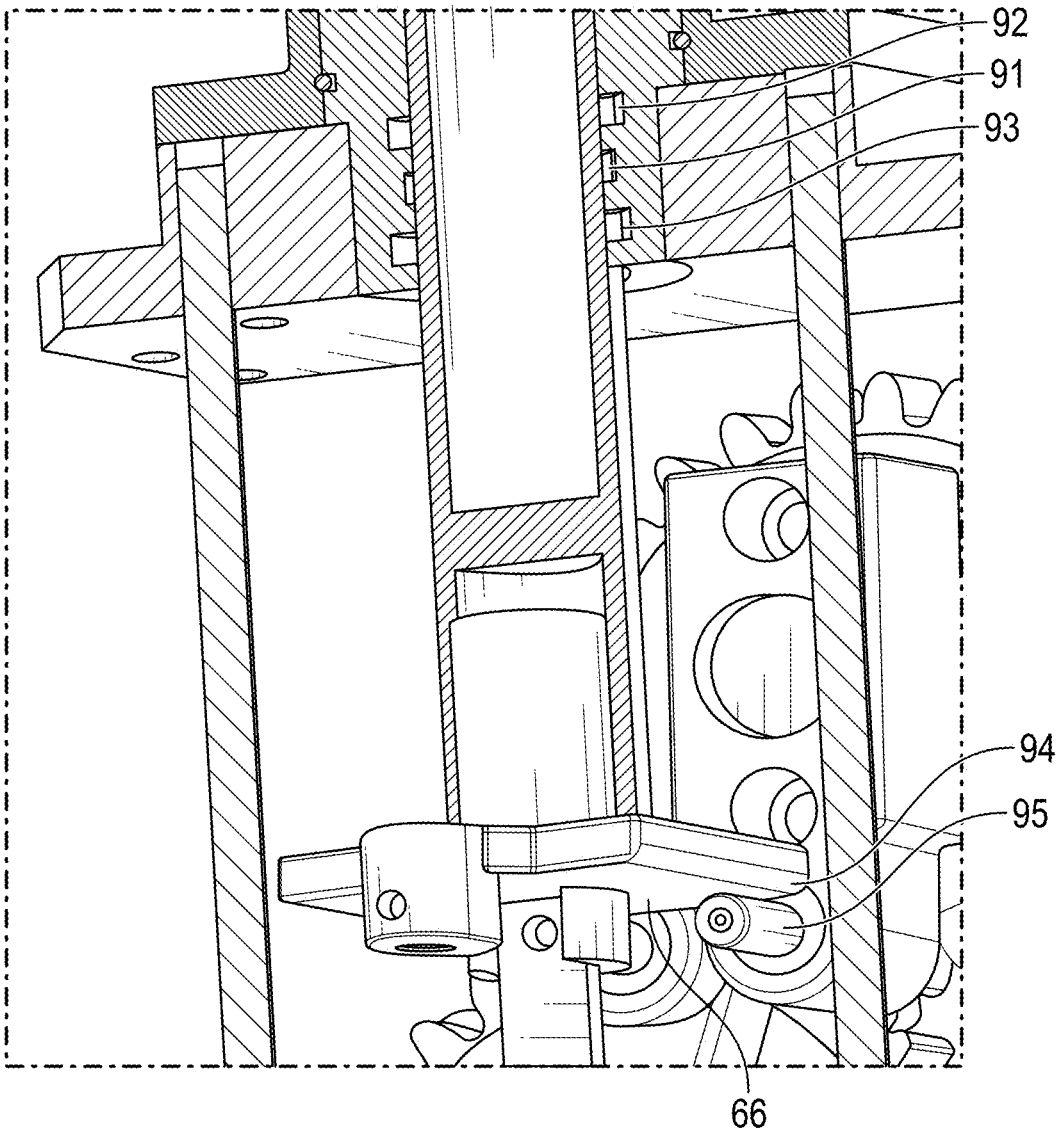
FIG. 8 illustrates a perspective view of a fastener driving apparatus including a minimum radius of curvature according to one or more aspects of the disclosed subject matter.

In an embodiment, with reference to FIG. 8, the apparatus 100 can include an oil reservoir 91 between two seals 92, 93 (e.g., O-ring seals, X ring Seals, etc.). For example, when the oil reservoir 91 is positioned between the two seals 92, 93, the lifetime of the apparatus 100 is significantly improved. More specifically, when the rod travels past one seal (e.g., seal 92) in a first direction, it picks up lubricant (e.g., from the oil reservoir) which is wiped off on the other seal (e.g., seal 93). Similarly, when the rod travels in a second direction (which is opposite the first direction) past seal 93 first, the rod picks up lubricant (e.g., from the oil reservoir) which is wiped off on the seal 92. By positioning the oil reservoir 91 between the two seals 92, 93, the seals are prevented from drying out, which significantly extends the life of the apparatus 100.

In an embodiment, two or more lip seals can be used in the gas spring. For example, the two seals 92, 93 can be lip seals. It was unexpectedly discovered that this extends gas spring life. For example, lip seals can accommodate higher pressure and surface speeds compared to O-rings or x-rings.

In an embodiment, it was unexpectedly discovered that substitution of a low density coated rod for the more conventional steel rod in a gas spring significantly improved the performance. The tool had far less recoil upon drive when the mass accelerated by the potential energy in the gas spring was reduced. In a still further refinement, it was found that using a hard coating which was significantly harder than the rod bushing allowed for acceptable life. For example, coatings can include hard anodize, nitride, electroless nickel and/or ceramic.

In an embodiment, the pressure increase in the at least one gas spring during actuation of the at least one gas spring by the drive mechanism is less than 30% of the pressure in the gas spring prior to being acted on by the drive mechanism. The drive mechanism can also include one or more lifting mechanisms (first and second lifting mechanisms 44 and 46), reference to the drive mechanism and the drive and lifting mechanism can be interchangeable. In an embodiment, and shown in FIG. 3, the gas spring rod comprises a piston flange 90. In a preferred embodiment, the area of the piston flange 90 is no more than 80% of the cross-sectional area of the gas spring cylinder. The relatively small size of the flange 90 in relation to the size of the gas spring chamber contributes to a substantial increase in the energy output of the apparatus 100. In other words, because the reduced cross section flange configuration results in an improved airflow past the flange, there is an unexpected increase in efficiency of the apparatus 100 as a result. This efficiency resulted from the elimination of an unexpected airbrake which otherwise occurs as a result of the high air velocities between the piston flange and the cylinder wall during the fastener drive stroke.

Figure 6:
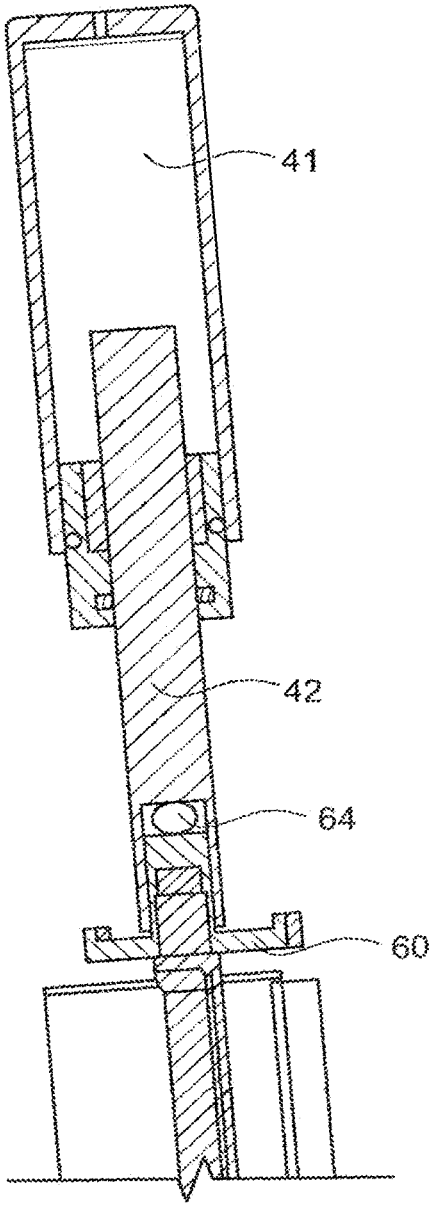
FIG. 6 illustrates a perspective view of a fastener driving apparatus in which a compliance is present between the anvil or anvil assembly and the gas spring rod that allows limited movement in the plane that is perpendicular to the fastener drive axis according to one or more exemplary aspects of the disclosed subject matter.

FIG. 6 illustrates a perspective view of the fastener driving apparatus in which a compliance is present between the anvil or anvil assembly and the gas spring rod that allows limited movement in the plane that is perpendicular to the fastener drive axis according to one or more exemplary aspects of the disclosed subject matter. In an embodiment, compliance 64 is added between the anvil 62 or the anvil assembly 60 and the gas spring rod 42. Compliance 64 allows limited movement in the plane that is approximately perpendicular to the fastener drive plane. As a result, it was unexpectedly discovered that adding compliance 64, as illustrated in FIG. 3 and FIG. 6, resulted in an increased seal and gas spring life as measured by gas spring pressure during cycling. An exemplary embodiment of such compliance 64, in the form of a coupling between the anvil assembly and the gas spring rod, is shown in FIG. 3 and FIG. 6. In one aspect, an exemplary coupling of a compliance 64 can be a ball-and-socket joint arrangement. This unexpected discovery is a result of the loads seen during a fastener drive which previously could cause the seal 48 to burp a small amount of gas during the impacting and/or fastener drive. As a result, the compliance 64 further improved the wear characteristics on the seal by reducing side-loading on the seal from the lifting mechanism. Additionally, with reference to FIG. 9, to compensate for the offset loading during the lifting of the anvil/anvil assembly, the apparatus 100 can include an outboard guide 98 to reduce side loading on gas spring bushings. An outboard guide 98 improves the guiding of the anvil assembly and helps to prevent misalignment.

Figure 7:
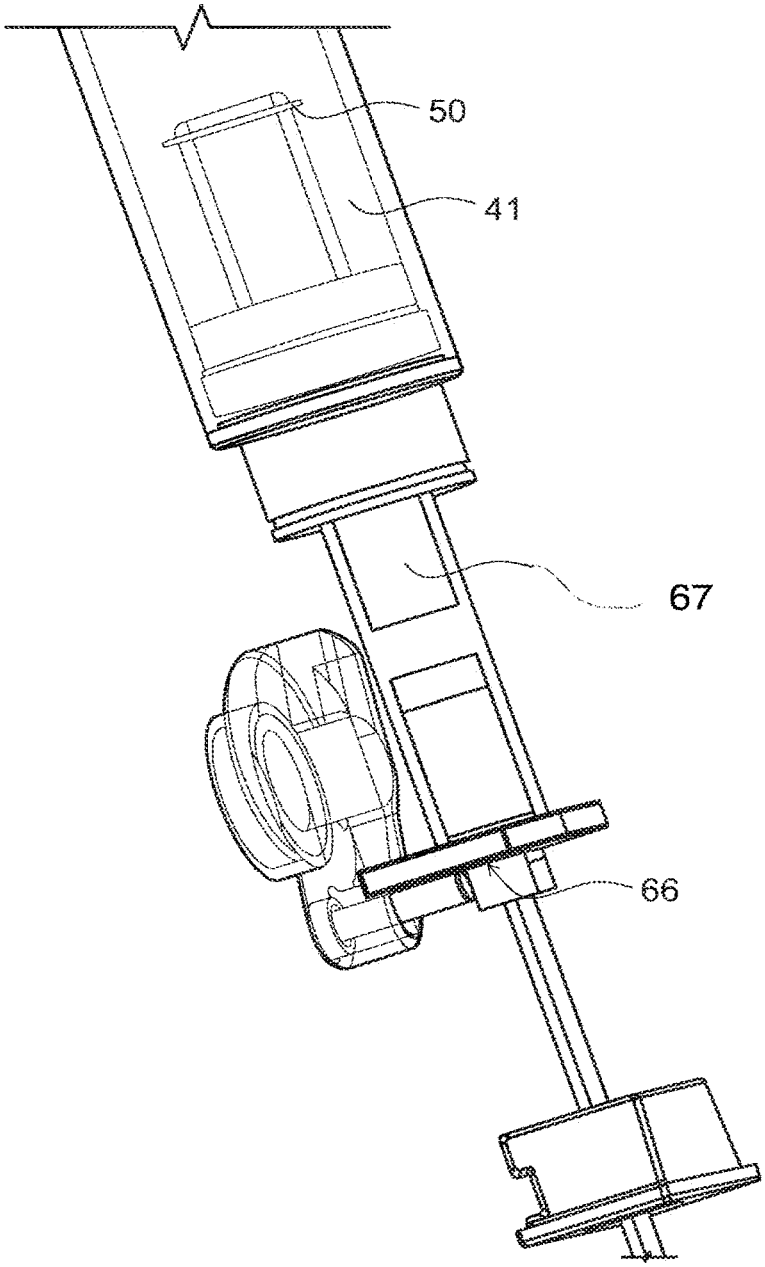
FIG. 7 illustrates a perspective view of the anvil assembly comprising at least two distinct materials of construction according to one or more exemplary aspects of the disclosed subject matter.

FIG. 7 illustrates a perspective view of the anvil assembly comprising at least two distinct materials of construction according to one or more exemplary aspects of the disclosure. In one aspect, and referring to FIG. 7, it was discovered that if the anvil assembly comprises an area 66 of the anvil or anvil assembly that has high modulus of elasticity material and high strength (such as in the region of the anvil or anvil assembly that is in contact with the lifters) and a low density material for the area 67 of the anvil or anvil assembly that engages the rod that the overall life and operation of the apparatus was improved. It is preferable that the portion of the anvil or anvil assembly that contacts the lifters has an elastic modulus of at least 25 million psi, and preferably 28 million psi coupled with a yield strength of at least 100 kpsi, and that the portion of the anvil assembly which engages the gas spring (including the gas spring rod) has a density of less than 0.15 pounds per cubic inch. Exemplary materials are steels and stainless steels for the anvil/anvil assembly component that contacts the lifter and aluminum, fiberglass, carbon fiber or magnesium for the gas spring rod and gas spring rod engagement region on the anvil/anvil assembly.

In one aspect, the apparatus 100 can also include a one way bearing or clutch 96 (shown in FIG. 2) that prevents the anvil 62/anvil assembly 60 from being drawn backward during the operational cycle of the apparatus.

Additionally, at least one bumper 70 may be disposed on the apparatus 100 for absorbing a portion of the force of impact of the anvil 62/anvil assembly 60 to reduce wear and tear on the components of the apparatus 100. The at least one bumper 70 may be of an elastic material and may be disposed on the apparatus 100 at any position where it is capable of absorbing a portion of the force of impact by the anvil 62/anvil assembly 60.

Figure 4:
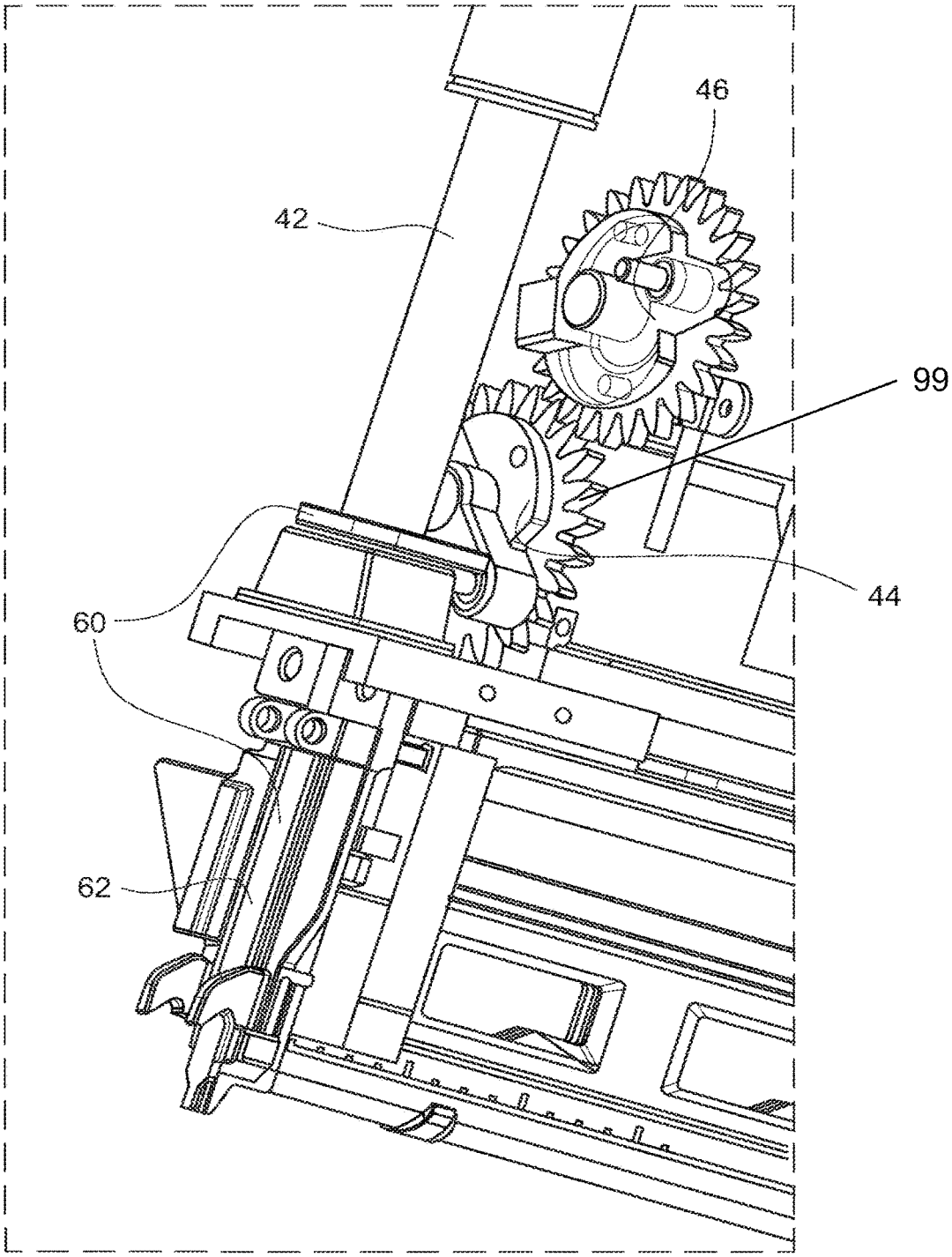
FIG. 4 illustrates a perspective view of a fastener driving apparatus in which a lifter is increasing the gas spring compression energy as the gas spring moves from the finish of the fastener drive stroke according to one or more exemplary aspects of the disclosed subject matter.

FIG. 4 illustrates a perspective view of a fastener driving apparatus in which a lifter is increasing the gas spring compression energy as the gas spring moves from the finish of the fastener drive stroke according to one or more exemplary aspects of the disclosed subject matter. As shown in FIG. 4, at least one of the lifters is capable of returning the anvil 62/anvil assembly 60 to and/or retaining the anvil 62/anvil assembly 60 in the position that is distal to the gas spring prior to commencement of another operational cycle.

In one aspect, the driving cycle of the apparatus 100 disclosed herein may start with an electrical signal, after which a circuit connects a motor 30 to the electrical power source 10. The motor 30 is operatively coupled at least one lifting mechanism. In an operational cycle of the apparatus 100, a first or lower lifting mechanism 44 may act on the anvil 62/anvil assembly 60 to lift the anvil 62/anvil assembly 60 from a point that is distal to the gas spring 40. At an intermediate midpoint of the cycle where the anvil 62/anvil assembly 60 is stable, the motor 30 may stop at a preferred stopping point. In one aspect, the stopping point corresponds to the drive and lifting mechanism having re-engaged the gas spring to relieve at least 80% of the force of the anvil 62/anvil assembly 60 from the gas spring. It was discovered that this stopping results in a lower latency (i.e., the time between a trigger pull and a fastener drive) than if the stopping point was without a lifter engaged or only engaged within 10% of the lifting stroke.

The mechanism can continue when the second or upper lifting mechanism 46 thereafter continues to actuate the anvil 62/anvil assembly 60 into or upon the gas spring 40 to increase the potential energy within the gas spring. The second or upper lifting mechanism 46 thereafter may eventually temporarily release from or disengage the anvil 62/anvil assembly 60 to allow the gas spring 40 to act on and move the anvil 62/anvil assembly 60 back toward the point that is distal to the gas spring 40 so that the anvil 60/anvil assembly 62 may impact or drive a fastener.

FIG. 5 illustrates a perspective view of a fastener driving apparatus in which the apparatus stops in in an intermediate position according to one or more exemplary aspects of the disclosed subject matter. By providing an intermediate stopping point (e.g., as shown in FIG. 5) in the operational cycle of the apparatus 100, the following benefits are realized. The gas spring may be partially energized or charged before the stopping point such that, after resumption of the engagement of the at least one lifters on the gas spring after the stopping point, a relatively small increase of energy in the gas spring thereafter is required to generate a sufficient amount of stored energy in the gas spring for subsequent release to effectively drive a fastener. Furthermore, the stopping point permits for secure retention of the anvil/anvil assembly in a fixed position in the event that there is a jam in the apparatus, such that the operator may clear the jam without concern that the gas spring would apply a force to the fastener resulting in a hazardous condition for the operator.

FIG. 8 illustrates a perspective view of a fastener driving apparatus (e.g., the apparatus 100) including a minimum radius of curvature according to one or more aspects of the disclosed subject matter. In one embodiment, the area 66 can include a radius of curvature 94. In one aspect, the radius of curvature 94 can have a minimum radius of curvature of at least 25% of the upper follower radius. For example, a portion of the area 66 where the releasing lifter (e.g., upper lifter in this example) disengages from the lifting plate can have a minimum radius of curvature. Originally, it was thought that a very small radius of curvature would result in a better performing tool, but it was unexpectedly discovered that the small radius of curvature causes very high forces as the upper follower releases from the anvil assembly resulting in severe deformation, wear and a very short tool life. Accordingly, in an embodiment, the radius of curvature can be at least 25% and preferably 50% of the radius of the upper follower 95. Additionally, in an embodiment, the apparatus 100 can include an over-running ability to reduce the side loading on the gas spring bushing at the release point from the lifter.

Figure 9:
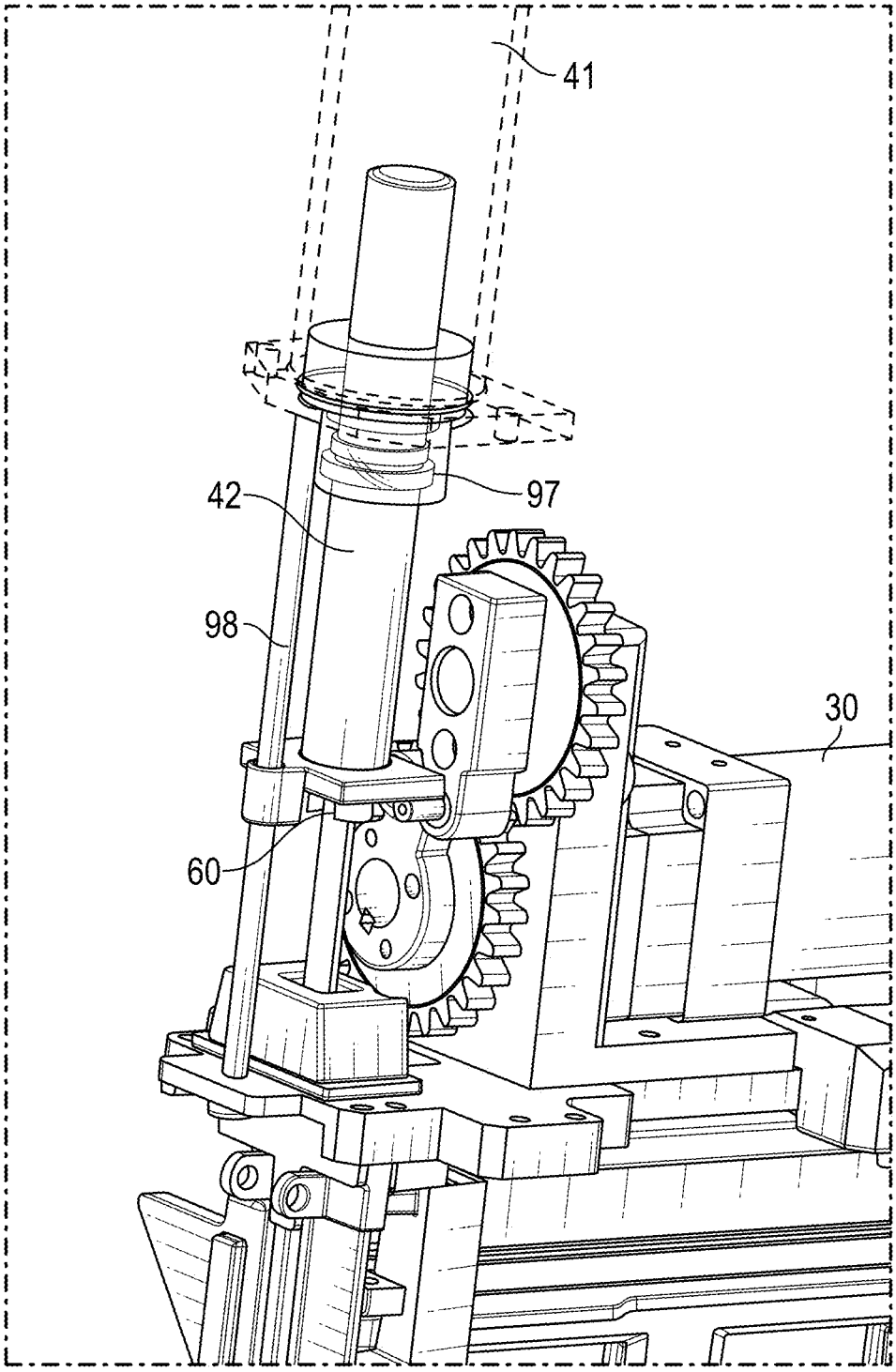
FIG. 9 illustrates a perspective view of a fastener driving apparatus including an outboard guide according to one or more aspects of the disclosed subject matter.

FIG. 9 illustrates a perspective view of a fastener driving apparatus (e.g., the apparatus 100) including an outboard guide 98 according to one or more aspects of the disclosed subject matter. As illustrated in FIG. 9, the apparatus 100 can include the gas spring cylinder 41, the motor 30, the anvil assembly 60, the rod 42, and bushings with seals 97. As has been described herein, the outboard guide 98 can reduce side loading on the gas spring rod.

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant(s) intend(s) to embrace all such alternatives, modifications, equivalents, and variations that are within the spirit and scope of the disclosed subject matter.

The invention claimed is:

1. A fastener driving apparatus, comprising:

a power source;

a control circuit;

a motor;

at least one gas spring, the at least one gas spring including a chamber and a rod disposed within the chamber, wherein the gas spring includes a rod seal, the rod seal being stationary with respect to movement of the rod;

a drive mechanism, the drive mechanism being capable of selectively engaging and disengaging the at least one gas spring, the at least one gas spring capable of moving to an energized position upon being engaged by the drive mechanism, wherein the drive mechanism continues to operate and re-engages the gas spring to relieve force on an anvil prior to stopping of the drive mechanism; and an anvil assembly, the anvil assembly including the anvil, wherein the drive mechanism includes a first lifting mechanism and a second lifting mechanism, wherein the first lifting mechanism actuates the at least one gas spring for a portion of an operation cycle, and the second lifting mechanism thereafter actuates the at least one gas spring for a subsequent portion of the operation cycle before the drive mechanism ceases applying a force on the at least one gas spring and the at least one gas spring releases at least a portion of its potential energy and accelerates the anvil to drive a fastener.

2. The fastener driving apparatus of claim 1, wherein the first lifting mechanism remains engaged with the at least one gas spring for a period of the operational cycle in which the second lifting mechanism is engaged with the at least one gas spring.

3. The fastener driving apparatus of claim 1, wherein the gas spring has an operating pressure of at least 200 psia during the entire operational cycle.

4. The fastener driving apparatus of claim 1, further comprising at least one sensor to detect at least one position of one or more of the anvil, anvil assembly, drive mechanism, motor, and gas spring.

5. The fastener drive apparatus of claim 4, wherein at least one lifter mechanism remains powered until the sensor detects movement of the anvil away from the fastener.

6. The fastener driving apparatus of claim 1, wherein the operational cycle includes a stopping point after the first lifter and the second lifter have engaged the at least one gas spring on a same lifting plane.

7. The fastener driving apparatus of claim 1, wherein the rod further includes a flange, wherein a rod flange area is no more than 80% of the cross sectional area of the gas spring cylinder and wherein the gas pressure increase within the gas spring is less than 30% of the initial pressure during any point in the operational cycle.

8. The fastener drive apparatus of claim 1, wherein the control circuit is configured to reduce power to the motor in response to the motor current exceeding 150% of an average current drawn while the potential energy of the gas spring is increasing.

9. The fastener drive apparatus of claim 1, wherein the drive mechanism further comprises a one-way clutch.

10. The fastener driving apparatus of claim 1, further comprising an operative connection between one of the anvil or anvil assembly and the rod for the entire operational cycle, the connection permitting compliance in a plane perpendicular to the stroke of the anvil.

11. The fastener driving apparatus of claim 1, wherein the rod includes a hard coating.

12. The fastener driving apparatus of claim 1, wherein the gas spring further comprises:

a first seal;

a second seal; and an oil reservoir positioned between the first seal and the second seal.

13. The fastener driving apparatus of claim 1, wherein an area of the anvil or anvil assembly where the second lifting mechanism disengages from the anvil or anvil assembly includes a minimum radius of curvature which is at least 25% of the radius of the upper follower of the lifting mechanism.

14. A fastener driving apparatus, comprising:

a power source;

a control circuit;

a motor;

at least one gas spring, the at least one gas spring including a chamber and a rod disposed within the chamber;

a drive mechanism, the drive mechanism being capable of selectively engaging and disengaging the at least one gas spring, the at least one gas spring capable of moving to an energized position upon being engaged by the drive mechanism; and an anvil assembly, the anvil assembly including an anvil, wherein the drive mechanism includes a first lifting mechanism and a second lifting mechanism, wherein the first lifting mechanism actuates the at least one gas spring for a portion of an operation cycle, and the second lifting mechanism thereafter actuates the at least one gas spring for a subsequent portion of the operation cycle before the drive mechanism ceases applying a force on the at least one gas spring and the at least one gas spring releases at least a portion of its potential energy and accelerates the anvil to drive a fastener, wherein the anvil assembly includes at least two materials including a first material comprising an elastic modulus of at least 28 million psi and a second material having a density of less than 0.15 pounds per cubic inch.

15. A fastener driving apparatus, comprising:

a power source;

a control circuit;

a motor;

at least one gas spring, the at least one gas spring including a chamber and a rod disposed within the chamber, wherein the gas spring includes a rod seal, the rod seal being stationary with respect to movement of the rod, a seal which acts against the rod, the rod being capable of moving linearly within the chamber and with respect to the seal;

a drive and lifting mechanism, the drive and lifting mechanism being capable of selectively engaging and disengaging the at least one gas spring, the at least one gas spring being capable of moving to a position of increased potential energy upon being engaged by the drive mechanism, wherein the drive mechanism continues to operate and re-engages the gas spring to relieve force on an anvil prior to stopping of the drive mechanism; and an anvil assembly, the anvil assembly including the anvil, the anvil assembly being coupled to the gas spring rod, wherein the drive and lifting mechanism selectively lifts the at least one gas spring to apply a force on the at least one gas spring to move the rod of the at least one gas spring at least 80% of the stroke of the anvil assembly and thereafter releases from and ceases applying a force on the at least one gas spring, wherein the at least one gas spring releases at least a portion of its potential energy and accelerates the anvil to drive a fastener.

16. The fastener driving apparatus of claim 15, wherein an operational cycle of the drive and lifting mechanism comprises a stopping point in which the drive and lifting mechanism has re-engaged the gas spring to relieve at least 80% of the force on the anvil from the gas spring.

17. The fastener driving apparatus of claim 15, wherein the pressure in the gas spring is at least 200 psi for the entire cycle.

18. The fastener driving apparatus of claim 15, wherein the control circuit is configured to reduce power to the motor in response to the motor current exceeding 150% of an average current drawn while the potential energy of the gas spring is increasing.

* * * * *